US005954241A

United States Patent [19]

Huang

[11] Patent Number: 5,954,241

[45] Date of Patent: Sep. 21, 1999

[54] CONTAINER FOR RECEIVING AND DISPENSING OF PARTICULATES

[75] Inventor: Daiying Huang, Chicago, Ill.

[73] Assignee: The Pampered Chef, Ltd., Addison, Ill.

[21] Appl. No.: 08/920,107

[22] Filed: Aug. 26, 1997

[51] Int. Cl.[6] ..... B65D 47/20

[52] U.S. Cl. ..... 222/548; 220/253

[58] Field of Search ..... 222/516, 548, 222/555; 220/253

[56] References Cited

U.S. PATENT DOCUMENTS

| | | | |
|---|---|---|---|
| D. 188,631 | 8/1960 | Gorenflo | D7/589 |
| D. 378,041 | 2/1997 | Stovall | D7/670 |
| D. 401,115 | 11/1998 | Huang | D7/589 |
| 1,386,043 | 8/1921 | Wilson | 222/555 X |
| 1,592,362 | 7/1926 | Hermani | 222/555 X |
| 1,769,815 | 7/1930 | Wilson | 222/555 |
| 2,117,685 | 5/1938 | Smith, Jr. | 221/288 |
| 2,214,437 | 9/1940 | Punte et al. | 220/253 X |
| 3,214,068 | 10/1965 | Armour | 222/548 X |
| 3,237,819 | 3/1966 | Fillmore | 222/548 |
| 3,467,287 | 9/1969 | Marchant et al. | 222/555 X |
| 4,127,190 | 11/1978 | Sunnen | 206/535 |
| 4,271,979 | 6/1981 | Manz | 221/288 |
| 4,583,661 | 4/1986 | Clover, Jr. | 222/42 |
| 5,123,547 | 6/1992 | Poulos | 220/253 X |
| 5,660,341 | 8/1997 | Perkins | 241/93 |

*Primary Examiner*—Kenneth Bomberg
*Attorney, Agent, or Firm*—Olson & Hierl, Ltd.

[57] ABSTRACT

A particulate receiving and dispensing container having a vessel and a cooperating closure is provided. The vessel has a generally circular mouth with a segmental discontinuity therein. The vessel mouth is slidably engagable with a grater. Specifically, with the cylindrical housing end portions of a grater drum when so engaged, the segmental discontinuity is preferably located alongside portions of a hopper housing that are integral with end adjacent to the grater drum housing. After being charged with particulates from the grater, the vessel is separated from the grater and the vessel mouth is associated with a valve equipped closure which cooperates with the segmental discontinuity. Thus, an operating tab for opening and closing the closure valve moves in a depression in the closure. The depression in the closure fits into and over the segmented discontinuity.

12 Claims, 3 Drawing Sheets

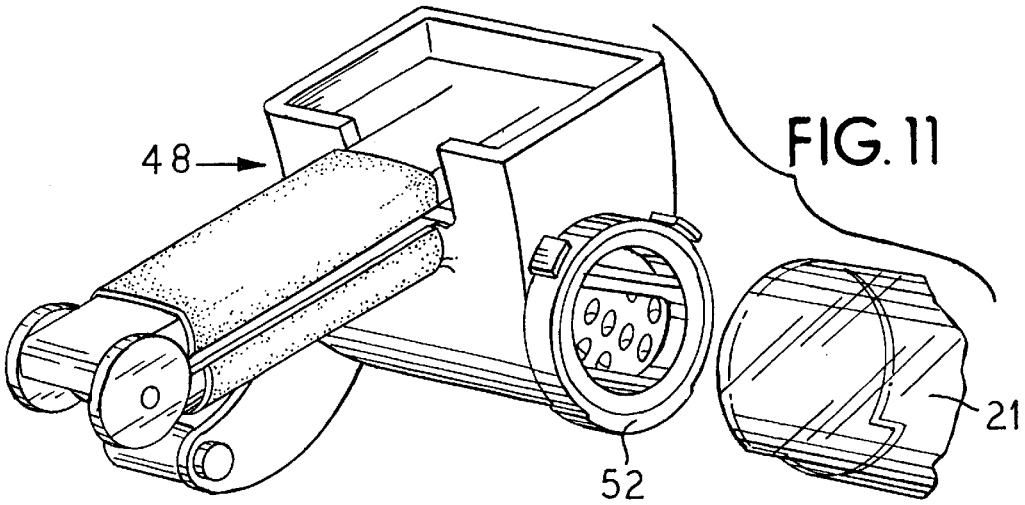
FIG. 11
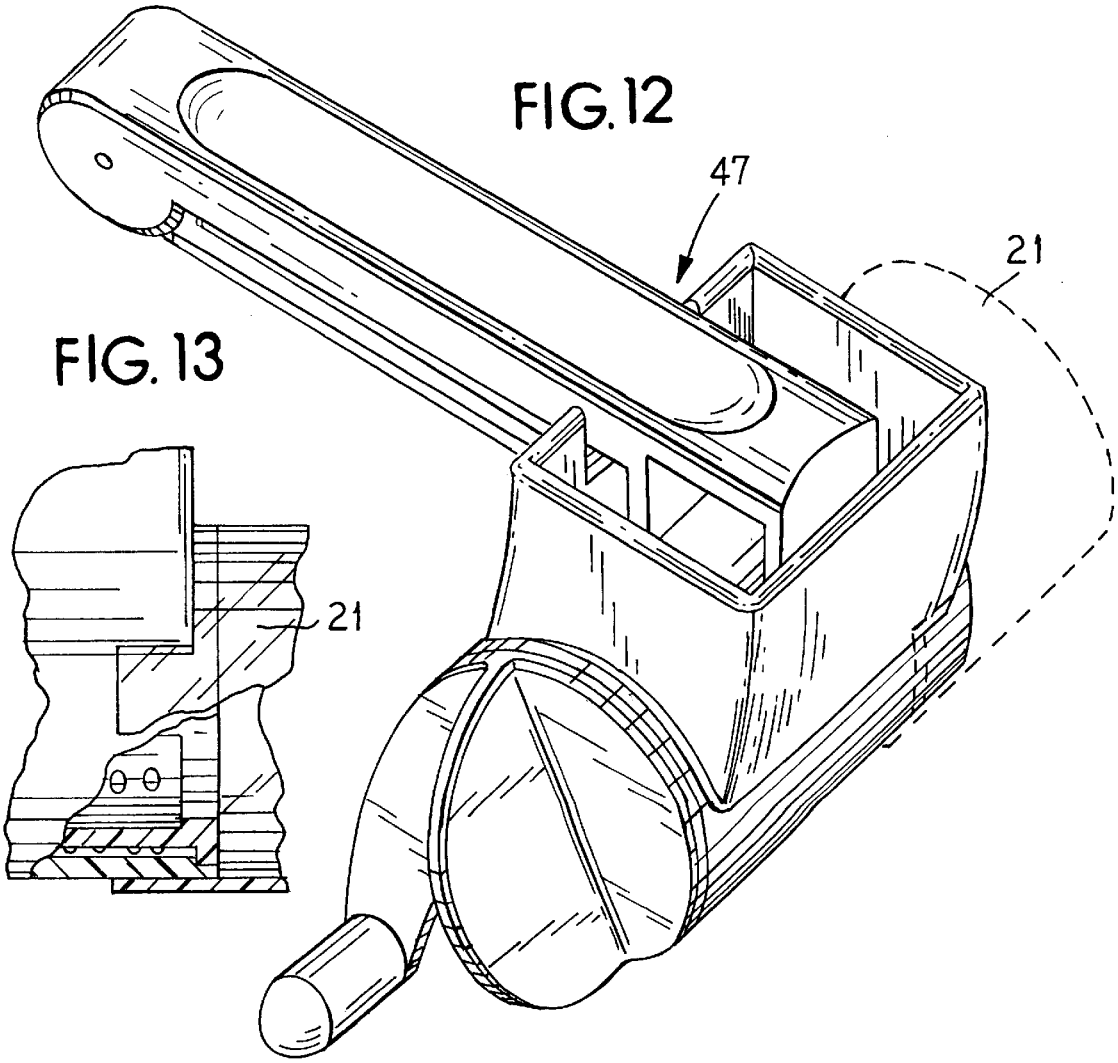
FIG. 12
FIG. 13

CONTAINER FOR RECEIVING AND DISPENSING OF PARTICULATES

FIELD OF THE INVENTION

This invention relates to containers with cooperating removable valve-equipped closure assemblies.

BACKGROUND OF THE INVENTION

It is common in food preparation to comminute, or grate a foodstuff with an appliance. However, the collection, storage and dispensing of the resulting food material can present problems.

For example, a rotary drum grater of the type useful for grating cheese and other foodstuffs is a very useful kitchen appliance. However, a foodstuff such as grated cheese or chocolate that is produced by a rotary drum grater must typically be picked up and moved from a collection location near the grater to a storage container. This procedure usually results in the loss of some of the grated material and the loss of time in transferring. Then, for subsequent use, the grated material must be dispensed through the typically large mouth of the storage container which can be an inaccurate procedure that tends to result in the additional loss of grated material.

The art needs a new and improved container that is both associatable with a kitchen appliance, such as a rotary drum grater, so as to receive and collect grated material from the grater, and that is also subsequently associatable with a valve closure. The closure valve means is needed for controlling the dispensing of the grated material stored in the closure-equipped container.

The present invention provides a new valve-equipped closure and associatable vessel combination which meets these needs. The combination that is adapted for the receiving of grated materials from a rotary drum grater or the like, and for the dispensing of grated materials stored in the combination.

SUMMARY OF THE INVENTION

This invention provides a new and very useful container comprising a vessel with a cooperating valve-equipped closure for the container mouth.

The vessel is adapted to be initially charged with particulate or grated material from a rotary drum grater or the like and then associated with the valve-equipped closure to store and to dispense the particulate material.

The mouth of the vessel is specifically configured for association with the drum region housing of a rotary grater structure so that grated particulates from the rotary grater enter directly into the vessel as a collection and storage receptacle. Thereby, the prior art problems of collecting grated particulates from the rotary grater are overcome.

The closure is adapted for removable association with the specially configured mouth of the vessel. The closure is manually slidably mounted over and about the vessel mouth after the vessel, with freshly grated particulates therein, is dissociated from the rotary grater structure.

The closure is also provided an aperture that has a manually operable valve. The valve permits the aperture to be opened or closed, and also permits the size of the aperture opening to be set intermediately between the fully open and fully closed configurations, as is desirable for the accurate and controlled regulating of the dispensing of stored particulate from the container. The valve is cooperatively connected with the closure and also coacts with the vessel mouth configuration. Thereby, the prior art problems of storing and dispensing of grated particulates are overcome.

Thus, the vessel, the closure, and the valve comprise an integrated and coacting assembly, yet the vessel is also cooperatively and removably associatable with housing portions of a rotary drum grater.

An object of this invention is to provide a vessel and an associatable valved closure combination for particulate material receiving and dispensing.

Another object is to provide, in a combination of the class indicated, a vessel having a mouth region which is specially configured for association with a prechosen region of a rotary drum grater housing so that the vessel can be associated with such region for purposes of collecting and receiving grated particulates produced by the rotary drum grater.

Another object is to provide, in a combination of the class indicated, a closure which fits over and about the specially configured mouth region of the vessel.

Another object is to provide, in a combination of the class indicated, a closure with a valved aperture for variable and manually controllable dispensing of particulates from the associated vessel.

Another object is to provide, in a combination of the class indicated, a closure and aperture valve combination that associates cooperatively and coacts with the specially configured mouth region of the vessel.

Other and further objects, arms, purposes, features, advantages, embodiments and the like of this invention will be apparent to those familiar with the art from the present specification, the accompanying drawings and the appended claims.

BRIEF DESCRIPTION OF DRAWINGS

In the drawings:

FIG. 11 is an exploded perspective view of the vessel of FIG. 1 with its closure removed showing the vessel oriented for slidable association with one embodiment of a rotary drum grater;

FIG. 12 is a perspective view of the vessel of FIG. 1 with its closure removed showing the vessel in phantom but in interconnected association with another embodiment of a rotary drum grater; and FIG. 13 is a fragmentary front end elevational view of the grater and vessel combination shown in FIG. 12, some parts thereof being shown in section and some parts thereof being broken away.

Figure 1:
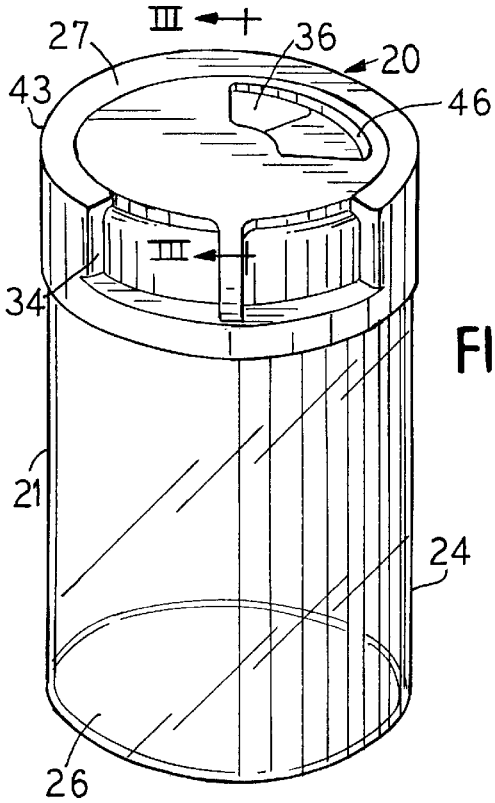
FIG. 1 is a perspective view of one embodiment of the inventive particulate receiving and dispensing container with its closure functionally associated therewith, and with its closure valve in a partially open configuration.
Figure 2:
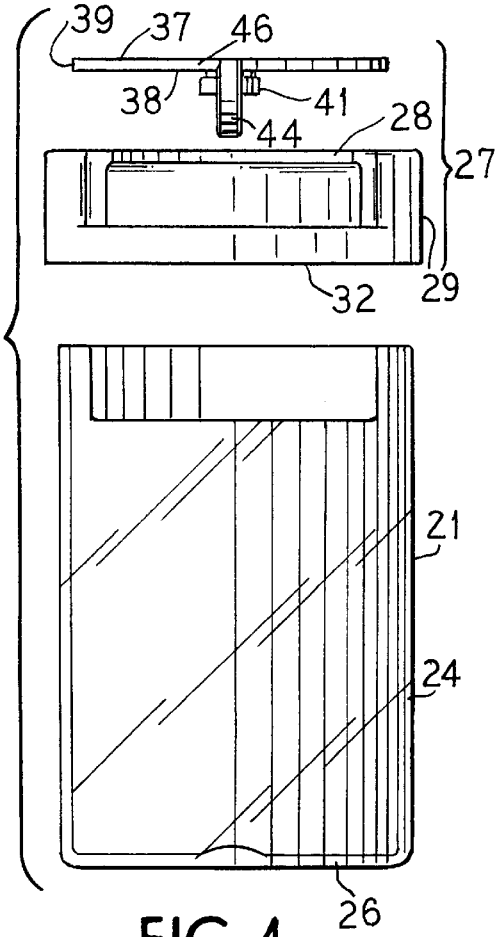
FIG. 2 is an exploded view in side elevation of the container of FIG. 1.

The foregoing description makes use of illustrative embodiments of this invention, and no limitations upon the present invention are to be implied or inferred therefrom.

DETAILED DESCRIPTION

Referring to the drawings, there is seen one embodiment 20 of a container for receiving and dispensing particulates. Container 20 utilizes a vessel 21 having a generally circular mouth 22 (in top plan) with a generally circumferentially extending segmental discontinuity or segment 23 defined in the mouth-adjacent contiguous lip portions 24A of vessel 21. The side edge of segment extends circumferentially in one plane; the opposite end edges are perpendicular in the side edge.

Circumferentially along the side edge of segment 23, the mouth 22 is set back (that is, set downwardly) axially (that is longitudinally) relative to remaining circumferentially adjoining mouth portions. Conveniently and preferably, the vessel side walls 24 are cylindrical, and are integral with, and continuously extend from, the mouth adjacent lip portions 24A downwardly to an integral vessel bottom wall 26. Conveniently and preferably, the vessel 21 is relatively rigid and is formed of a molded plastic, more preferably a clear plastic, such as a plastic comprised of an acrylic resin, a styrene resin or the like.

Container 20 utilizes a closure 27 for the mouth 22. The closure 27 has a central portion 28 and a peripherally extending (relative to the center portion 28) downturned flange portion 29 that is preferably contiguous to and integral with the central portion 28. The flange portion 28 has terminal regions 31 that are removably and matingly engagable with the lip portions 24A in regions thereof that are adjacent to the mouth 22 including the segment 23. Conveniently and preferably, the closure 27 is relatively rigid and is comprised of an opaque plastic.

Figure 3:
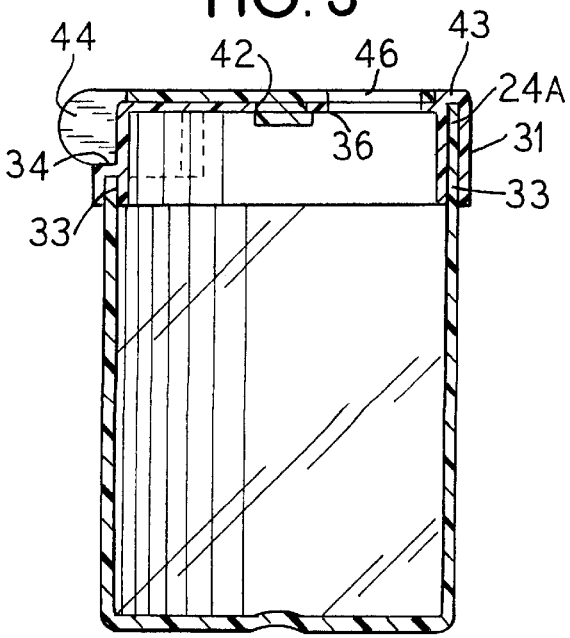
FIG. 3 is a vertical diametrical sectional view of the container of FIG. 1 taken from the right side of FIG. 1 along a plain generally perpendicular to the view shown in FIG. 1.
Figure 4:
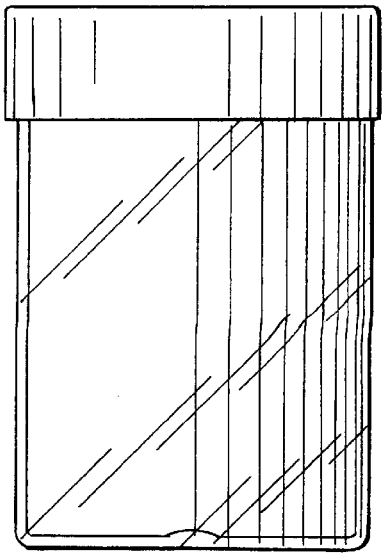
FIG. 4 is a back side (relative to FIG. 1) elevational view of the container of FIG. 1.
Figure 5:
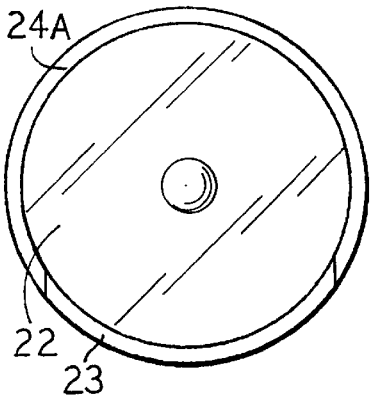
FIG. 5 is a top plan view of the container of FIG. 1 with the closure removed.
Figure 6:
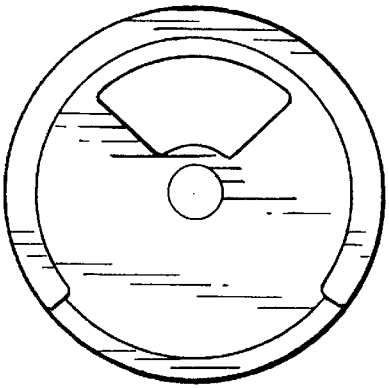
FIG. 6 is a top plan view of the closure body of FIG. 1 with the closure valve body removed.
Figure 7:
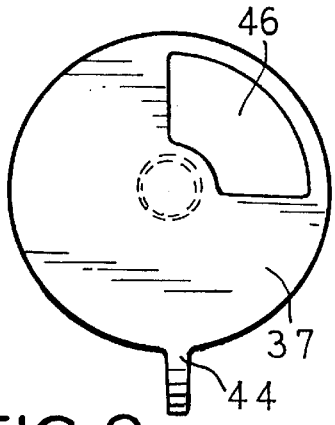
FIG. 7 is a top plan view of the valve body of FIG. 1.
Figure 8:
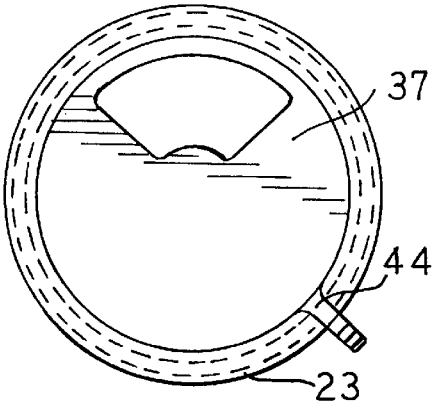
FIG. 8 is an assembly view of the closure of FIG. 1, but with the closure valve in its fully open position.
Figure 9:
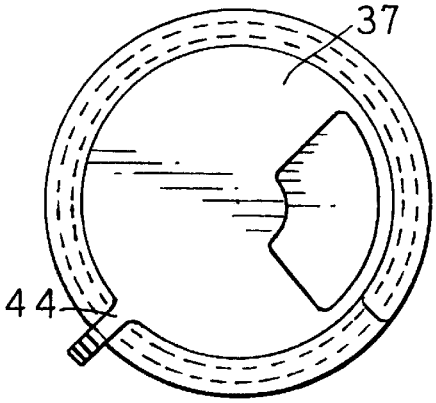
FIG. 9 is a view similar to FIG. 8, but with the closure valve in its fully closed position.
Figure 10:
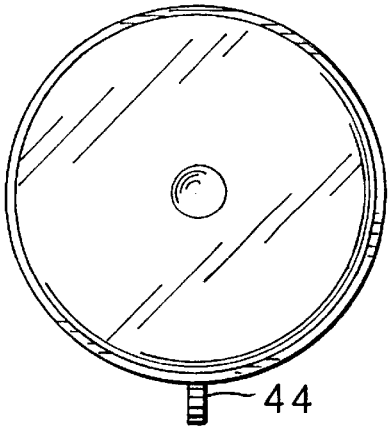
FIG. 10 is a bottom plan view of the container of FIG. 1.

Preferably, and as shown, the lower terminal regions 31 of flange portion 29 have defined in the lower edges 32 thereof a downwardly opening, continuously circumferentially and axially extending channel 33. The channel 33 is configured to be nestably received over mouth adjacent lip portions 24A including the segment 23 when the channel 33 is axially aligned with the corresponding portions of the lip portions 24A and the segment 23 (see FIG. 3, for example).

The flange portion 29 has a radially and axially recessed, circumferentially extending depression 34 defined therein. The depression 34, when said flange lower edges 32 are so engaged with the lip portions 24A, is configured to occupy the spatial zone defined by the segment 23.

The central portion 28 has a first aperture 36 defined therein. The aperture 36 is located in the central portion 28 between the center and the circumferentially extending peripheral portions of the central portion 28.

A valve plate 37 is provided which has an inside face 38 and a perimeter 39. The valve plate 37 is configured to extend slidably over upper regions of the central portion 28 including the first aperture 36. The perimeter 39 of the valve plate 37 preferably extends circumferentially. The inside face 38 of the valve plate 37 at its center has a downwardly extending stem member 41. Preferably, and as shown, the outer head of the stem member 41 is slightly enlarged circumferentially relative to the adjoining leg portions thereof. Resultingly, when the stem member 41 is inserted through an aperture 42 here defined in the center of the central portion 28, a snap fit-type of connection is achieved between the stem member 41 and the aperture or hole 42. The valve plate 37 is thus slidably rotatable relative to the central portion 28.

Preferably and as shown, the flange portion 29 cooperates with the central portion 28 to define an upturned, peripherally extending shoulder 43 that extends about the perimeter of the central portion 28 except in the region of the segment 23. The valve plate 37 is nestably received over the central portion 28 and is in radially adjacent relationship to the shoulder 43. Alternative arrangements can be used, if desired, as those skilled in the art will appreciate.

The valve plate 37 has a radially, outwardly extending, downwardly projecting tab member 44 defined on the perimeter 39 thereof. Also, the valve plate 37 has defined therethrough a second aperture 46.

The relationship between the stem member 41, the center of the central portion 28, the valve plate 37, the first aperture 36 and the second aperture 46, the tab member 44, and the depression 34 is such that the tab member 44 extends downwardly from the perimeter of valve plate 37 into the depression 34. The tab member 44 is slidably movable circumferentially in the depression 34. Thus, circumferential oscillatory movements of the tab member 44 bring the second aperture 46 into and out of registration with the first aperture 36, thereby opening and closing the first aperture 36 and adjusting the intermediate sizes of the first aperture 36. The tab member 44 is conveniently manipulated and moved by finger action.

As those skilled in the art will appreciate, while it is presently preferred (as shown) to employ a valve plate with a circular perimeter, and with a center or axis of rotation which is coaxial with the axis of the cylindrical side walls 44, other valve plate configurations and positions can be selected, if desired, as those skilled in the art will appreciate.

Also, as those skilled in the art will appreciate, while the valve plate 37 and the central portion 28 are (as shown) preferably flattened, various other non-planar configurations can be employed, if desired. For example, the central portion 28 can have a rounded or domed configuration with the valve plate 37 being correspondingly domed.

Like the first aperture 36, the second aperture 46 is located in the valve plate 37 between the center thereof and the perimeter thereof so as to registerable with the first aperture 36.

When not engaged with the closure 27, the mouth 22 and lip portions 24A of the vessel 21 are adapted to be slidably engagable with the output terminal cylindrical housing portions of a grater drum in a rotary drum grater. The segmental discontinuity 23 is preferably configured so that segment 23 is adapted to rest along and adjacent to housing or hopper portions of a rotary drum grater particularly portions which lie adjacent to the terminal end regions of the cylindrical housing portions for the grater drum.

For purposes of utilizing the vessel 21 in cooperative association with a rotary drum grater 47, a present preference is to employ a rotary drum grater 47 of a type which is configured as illustrated in FIGS. 12 and 13.

An alternative rotary grater structure 48 of a similar type which is also adapted for association with the vessel 21 is illustrated in FIG. 11.

In the rotary drum grater assembly shown in FIGS. 12 and 13, the vessel mouth 22 slides over the terminal flange portion of the cylindrical housing for the rotary drum in the grater 47.

The present invention thus provides a method for collecting, storing and dispensing grated particulates produced by a rotary drum grater. The method comprises the steps of first slidably associating mouth-adjacent lip portions of a vessel, such as vessel 21, having generally circular mouth 22 with a circumferentially extending, segmental discontinuity 23 defined in mouth-adjacent lip portions 24A. Mouth-adjacent lip portions are connected with terminal cylindrical housing portions of a rotary grater and surround the grater drum end region. Characteristically, the feed hopper housing of the rotary grater adjacently connects integrally portions of rotary drum housing that extends transversely across the housing. The segmental discontinuity of the mouth 22 preferably either is in adjacent relationship to bottom wall portions of the feed hopper as shown in FIG. 12 or is located adjacent to stabilizer legs 51 (here paired) and the segment is associated with an aligning cam 52, as shown for example in FIG. 11. After the vessel 21 has been so slidably engaged with the housing of the rotary drum grater 47 or 48, for examples, the rotary drum grater is operated and grated particulates are collected in the vessel 22 as discharged from the grater drum.

When the vessel is filled to a desired level with grated particulates, the vessel 21 is separated from the rotary drum grater housing portions with which it has been slidably associated.

Thereafter, the mouth-adjacent lip portions of the vessel with the particulates therein is slidably engaged with the rim portions of a closure, such as the valved closure 27.

A user can then dispense grated particulates stored in the vessel 21 from the vessel 21 while the closure valve is open and available for dispensing the stored particulates through the aperture 36.

The structure and operation of these rotary drum graters is illustrated by Perkins and Wolters U.S. Pat. No. 5,660,341 issued Aug. 26, 1997 and by co-pending U.S. patent application Ser. No. 08/920,159 filed Aug. 26, 1997 (identified by Docket No. PC-33).

The foregoing description makes use of illustrative embodiments of this invention, and no limitations upon the present invention should be implied or inferred therefrom.

What is claimed is:

1. A container for receiving and dispensing particulates comprising:

(a) a vessel having a generally circular mouth with a circumferentially extending segmental discontinuity defined in mouth adjacent lip portions thereof;

(b) a closure for said mouth, said closure comprising a central portion and a peripheral downturned flange portion that is engagable with said mouth adjacent lip portions, said flange portion including a radially recessed circumferentially extending depression defined therein, and first aperture means defined in said central portion; and (c) valve means pivotably extending over said central portion, said valve means including pivot means, tab means and second aperture means, said tab means being adapted to circumferentially and slidably move along and in said depression, said second aperture means being registerable with said first aperture means whereby reciprocal pivotal movements of said tab means opens and closes said first aperture means.

2. The container of claim 1 wherein said vessel mouth is further adapted to engage slidably terminal cylindrical housing end portions of a grater drum.

3. A container for receiving and dispensing particulates comprising in combination:

(a) a vessel having a generally circular mouth with contiguous integral generally cylindrical lip portions that define said mouth;

(b) said lip portions adjacent to said mouth having a circumferentially extending segment defined therein so that along said segment said mouth is set back axially relative to remaining mouth portions;

(c) a closure for said mouth, said closure having a central portion and a peripherally extending relative to said central portion downturned flange portion that is contiguous to and integral with said central portion;

(d) said flange portion having lower terminal regions that are removably and matingly engagable with said lip portions in regions thereof that are adjacent to said mouth including said segment;

(e) said flange portion having a radially and axially recessed, circumferentially extending depression defined therein, said depression when said flange portion lower terminal regions are so engaged with said lip portions being configured to occupy a spatial zone defined by said segment;

(f) said central portion having first aperture means defined therein;

(g) a valve plate having an inside face and a perimeter, said valve plate being configured to slidably extend over regions of said central portion including said aperture means, said valve plate having a projecting stem means on said inside face, a radially outwardly extending tab member defined on said perimeter, and second aperture means defined through said valve plate; and (h) said stem means being pivotably associated with a region of said central portion;

the relationship between said stem means, said pivotably associated region, said valve plate, said first and said second aperture means, said tab member end and said depression being such that said tab member extends downwardly from said valve plate into said depression and said tab member is slidably movable in said depression circumferentially, whereby circumferential oscillatory movements of said tab member bring said second aperture means into and out of registration with said first aperture mans, thereby opening and closing said first aperture means.

4. The container of claim 3 wherein said mouth of said vessel is further adapted to slidably and removably engage cylindrically configured end portions of a housing for a rotary drum grater, said end portions being adjacent terminal end regions of the rotary drum of said grater, whereby grated particulates discharged from said grater during operation thereof are directly collected in said vessel.

5. The container of claim 3 wherein said flange portion and said central portion cooperate to define an upturned shoulder and wherein said valve plate is nestably received over said central portion and radially adjacent said shoulder.

6. The container of claim 5 wherein said valve plate perimeter is circular and said pivotably associated region is coaxial with the axis of said cylindrical lip portions.

7. The container of claim 6 wherein said central portion and said valve plate are each generally flattened.

8. The container of claim 7 wherein said first and said second aperture means are each located in radially spaced relationship relative to said axis.

9. The container of claim 3 wherein said lower terminal regions have defined therein a downwardly opening continuously circumferentially extending channel which is configured to be nestably received over said mouth-adjacent lip portions including said segment when said channel is axially aligned with said lip portions and said segment.

10. The container of claim 3 wherein said segment subtends an angle that is smaller than about 180 degrees relative to the axis of said cylindrical lip portions.

11. The container of claim 10 wherein said segment subtends an angle that is at least about 20 degrees relative to the axis of said cylindrical lip portions.

12. The container of claim 1 wherein said segment subtends an angle in the range of about 30 degrees to about 75 degrees relative to the axis of said cylindrical lip portions.

* * * * *